US007212186B2

(12) United States Patent
Harano

(10) Patent No.: US 7,212,186 B2
(45) Date of Patent: May 1, 2007

(54) IMAGE DISPLAY DEVICE AND IMAGE DISPLAY PANEL

(75) Inventor: Tamaki Harano, Tokyo (JP)

(73) Assignee: Sony Corporation (JP)

( * ) Notice: Subject to any disclaimer, the term of this patent is extended or adjusted under 35 U.S.C. 154(b) by 568 days.

(21) Appl. No.: 10/755,224

(22) Filed: Jan. 13, 2004

(65) Prior Publication Data

US 2004/0145557 A1 Jul. 29, 2004

(30) Foreign Application Priority Data

Jan. 27, 2003 (JP) ..... P2003-017141

(51) Int. Cl.
*G09G 3/36* (2006.01)
*G09G 5/00* (2006.01)

(52) U.S. Cl. ..... 345/99; 345/213

(58) Field of Classification Search ..... 345/87–100, 345/204–215

See application file for complete search history.

(56) References Cited

U.S. PATENT DOCUMENTS 6,331,844 B1 * 12/2001 Okumura et al. ..... 345/87
6,366,231 B1 * 4/2002 Rao et al. ..... 341/166
6,525,593 B1 * 2/2003 Mar ..... 327/530
6,798,251 B1 * 9/2004 Schafferer ..... 327/52

* cited by examiner

*Primary Examiner*—Vijay Shankar
(74) *Attorney, Agent, or Firm*—Rader Fishman & Grauer PLLC; Ronald P. Kananen

(57) ABSTRACT

An image display device and an image display panel having a high accuracy of adjusting the sample timing of a video signal and capable of preventing a constant wasteful power consumption and comprising a timing detection circuit for generating a timing detection signal changing from a first level to a second level every time a switch circuit connected to each data line shared by pixels in each column sends a video signal, and the timing detection circuit including at an output terminal of a timing detection signal a means (for example, PMOS) for closing a current path on the first level side and a means (for example, NMOS) for opening a current path on the second level side respectively in synchronization with a video signal sending operation of the switch circuit.

10 Claims, 8 Drawing Sheets

1A: IMAGE DISPLAY PANEL
2: PIXEL PORTION
3: VERTICAL DRIVE CIRCUIT
4: HORIZONTAL DRIVE CIRCUIT
6: CLOCK GENERATION PORTION
7: CLOCK BUFFER CIRCUIT

1B : IMAGE DISPLAY PANEL
2 : PIXEL PORTION
3 : VERTICAL DRIVE CIRCUIT
4 : HORIZONTAL DRIVE CIRCUIT
7 : CLOCK BUFFER CIRCUIT

FIG.4A HST
FIG.4B HCK
FIG.4C HCKX
FIG.4D DCK1
FIG.4E DCK2
FIG.4F CP1
FIG.4G CP2
FIG.4H CP3
FIG.4I DP1 (DPodd)
FIG.4J DP2 (DPeven)
FIG.4K DP3 (DPodd)

IMAGE DISPLAY DEVICE AND IMAGE DISPLAY PANEL

BACKGROUND OF THE INVENTION

1. Field of the Invention

The present invention relates to an image display device and an image display panel wherein a so-called point sequential clock driving system is applied to a drive circuit.

2. Description of the Related Art

FIG. 1 and FIG. 2 are block diagrams of configuration examples of image display panels wherein the point sequential clock driving system is applied.

Image display panels 1A and 1B comprises, as show in FIG. 1 and FIG. 2, a pixel portion 2 arranged with pixels in a matrix, a vertical drive circuit (V.DRV) 3, a horizontal drive circuit (H.DRV) 4 and a precharge circuit (P.CHG) 5 as various circuits connected to the pixel portion 2.

The pixel portion 2 uses, for example, a liquid crystal cell as a display element (pixel) of an image. Each liquid crystal cell is provided with a liquid crystal element and a Thin Film Transistor (TFT) that is turned on when displaying for supplying a video signal SP to one electrode (pixel electrode) of the liquid crystal element. While not particularly shown, gates of the TFT on each row (one display line) are connected to a gate line and either one of the sources and drains of the TFT on each column are connected to a data line. The vertical drive circuit (V.DRV) 3 scans (sequentially drives every predetermined time) gate lines when displaying an image, and the horizontal drive circuit (H.DRV) 4 point-sequentially supplies display data of an amount of one display line to the data line (horizontal scan) in a driving time of the gate line (horizontal scan period). By combining the horizontal scan and the vertical scan, an image of one screen is displayed on the pixel portion 2.

In the point sequential clock driving system, the horizontal drive is controlled by a horizontal clock.

In the configuration example shown in FIG. 1, a clock generation portion 6 inside the panel generates horizontal clocks (hereinafter, referred to as drive clocks) DCK1 and DCK2 having a pulse width of a smaller duty ratio and reversed phases to each other and their inverted drive clocks DCK1X and DCK2X based on horizontal clocks HCK and HCKX having reversed phases to each other input from outside. When the horizontal drive circuit (H.DRV) 4 receives a horizontal start pulse (HST: not shown) from the outside or the clock generation portion 6, it shifts the horizontal start pulse (HST) by a built-in shift register driven by input horizontal clocks HCK and HCKX having reversed phases to each other, extracts drive clocks DCK1 and DCK2 based on the shifted pulse and generates a drive pulse for driving a data sampling switch (HSW). The data sampling switch (HSW), while not particularly illustrated, is provided to an output stage of the horizontal drive circuit (H.DRV) 4 or a video signal input portion of the pixel portion 2 and samples point-sequentially an input video signal by the horizontal drive pulse. Note that, in FIG. 1, a clock buffer circuit 7 is provided in accordance with need. In this case, the clock buffer circuit 7 adjusts the horizontal clock HCK by using the horizontal clock HCKX, adjusts the drive clock DCK1 by using the drive clock DCK1X, adjusts the drive clock DCK2 by using the drive clock DCK2X and outputs the adjusted drive clocks DCK1 and DCK2. Also, the clock buffer circuit 7 converts a voltage level of various clocks to a voltage suitable to panel driving.

On the other hand, in the configuration example shown in FIG. 2, the horizontal clock HCK and its inverted clock HCKX, drive clocks DCK1 and DCK2 and their inverted drive clocks DCK1X and DCK2X for driving the horizontal drive circuit (H.DRV) 4 are all given from outside of the panel.

Note that a start pulse and a clock for driving the vertical drive circuit (V.DRV) 3 are omitted in FIG. 2. Also, in this case, a clock buffer circuit 7 having the same function as that in FIG. 1 is provided in accordance with need.

An active element of the variety of circuits incorporated in the panel is composed of a large number of TFTs formed on the same substrate as that of the pixel portion 2. The TFT has larger characteristic variation compared with a bulk transistor, and the characteristic is easily changed by aging and other heat treatment. When the characteristic of the TFT changes, particularly, a sample timing by the data sampling switch (HSW) is deviated. The deviation of the sample timing causes a phenomenon called "ghost", that is, an undesirable image generated by deviating by certain dots from a correct image position overlaps with the correct image on the display screen.

To prevent the ghost, there is known a timing adjustment technique of sampling an operation by detecting deviation of the sampling pulse due to changes of characteristics of the transistor and feeding it back to the generation of timing of the horizontal clock.

FIG. 9 is a view of a configuration example of a detection circuit provided inside the horizontal drive circuit 4.

The detection circuit 100 of the present example deals with the fact that the data sampling switch HSW for actually sending a video signal to pixels is composed of a high speed CMOS transfer gate. Namely, the detection circuit 100 comprises a CMOS transfer gate 101 provided at a position adjacent to the data sampling switch HSW for sending a video signal to pixels in the horizontal drive circuit 4, and the transfer gate 101 is composed of a TFT to be formed at a time having the same size as that of the CMOS transfer gate composing the data sampling switch HSW.

The CMOS transfer gate 101 comprises a PMOS transistor 101P and a NMOS transistor 101N wherein sources are connected to each other and drains are connected to each other. The mutually connected one terminal is grounded here, while it is connected to a supply line of a video signal SP in the data sampling switch HSW.

Based on a drive clock DCK1 (or DCK2) to be input, a circuit 102 for generating a pair of horizontal drive pulses DP and DPx having reversed phases to each other is connected to gates of the two transistors 101P and 101N.

The mutually connected other terminal is taken out to the outside of the panel via wiring and connected to an input of a so-called feedback IC 110. A node in the middle of the wiring is connected to a supply line of a power source voltage Vdd via a pull-up resistance 111.

When the CMOS transfer gate 101 turns on in the case horizontal drive pulses DP and DPx are applied, a potential of the output shifts from a state of being pulled up by the power source voltage Vdd to the ground potential GND. When the application of pulses is finished, the CMOS transfer gate 101 turns off, so that a potential of wiring rises in accordance with at time constant determined by resistance RL and a capacitance CR of the wiring.

The feedback IC 110 detects the potential change from a high level to a low level and detects the deviation of a phase of the horizontal drive pulse from a potential change amount. More specifically, the output of the CMOS transfer gate 101 changes to the maximum (or a constant value close to the maximum) when there is no phase deviation, while when there is a phase deviation, the potential change amount becomes small in accordance with the deviation amount. The feedback IC 110 estimates the deviation amount of the phase from the potential change amount, adjusts the timing of generating pulses of the horizontal clocks HCK and HCKX so as not to cause phase deviation, and sends it back to the image display panel again.

However, there is a case where particularly the low level of a detection signal is not lowered completely to the ground potential GND, due to deterioration of characteristics of the TFT. In this case, the potential at the low level varies in accordance with how the characteristics of the TFT decline and does not become constant. The feedback IC 110 basically estimates the deviation amount of a phase by using as a reference the potential difference of the power source voltage Vdd and the ground potential GND (or a constant value close to that), but the reference fluctuates in this case. As a result, the accuracy of feedback control declines and the timing of the clock is adjusted to a wrong value.

The decline of accuracy of feedback control becomes notable as the number of horizontal pixels of the image display panel increases and the cycle of the sampling pulse becomes shorter.

Also, when off-leakage of the TFT increases due to the characteristic decline, a current flows from the power source voltage Vdd to the ground potential via the CMOS transfer gate 101 in a turned off state, and consequently, power consumption increases in the image display device or image display panel.

SUMMARY OF THE INVENTION

An object of the present invention is to provide an image display device and an image display panel for improving the accuracy of adjusting the sample timing of a video signal and preventing a constant wasteful power consumption.

According to the present invention, there is provided an image display device, having a pixel portion arranged with pixels in a matrix and a drive circuit including a switch circuit connected to each data line shared by pixels in each column of the pixel portion for sampling a video signal and successively outputting to the data line, comprising a timing detection circuit for generating a timing detection signal changing from a first level to a second level every time the switch circuit sends the video signal, and a timing adjustment circuit for adjusting an operation timing of the switch circuit based on the timing detection signal, wherein the timing detection circuit includes at an output terminal of the timing detection signal a means for closing a current path on the first level side and a means for opening a current path on the second level side, respectively, in synchronization with a video signal sending operation of the switch circuit.

According to the present invention, there is provided an image display panel, having a pixel portion arranged with pixels in a matrix and a drive circuit including a switch circuit connected to each data line shared by pixels in each column of the pixel portion for sampling a video signal and successively outputting to the data line, comprising a timing detection circuit for generating a timing detection signal to be output to the outside of the panel, changing from a first level to a second level every time the switch circuit sends the video signal, and wherein the timing detection circuit includes at an output terminal of the timing detection signal a means for closing a current path on the first level side and a means for opening a current path on the second level side, respectively, in synchronization with a video signal sending operation of the switch circuit.

In an image display device and an image display panel having the configuration as above, horizontal scanning wherein a video signal is sampled and sent to the data line by the drive circuit is performed during an image display operation. At this time, every time the switch circuit provided inside the drive circuit sends a video signal to the data line, a potential of the timing detection signal output from the timing circuit shifts from a first level to the second level. The timing detection circuit is provided with a means for closing a current path on the first level side and a means for opening a current path on the second level side, respectively in synchronization with an operation of sending the video signal of the switch circuit. Therefore, the potential is swiftly changed from the first level to the second level. When these means are composed of a transistor, it is affected by the characteristic decline, but due to the provision of the two means, the drive performance of potential change improves remarkably. Therefore, even when characteristics of transistors, etc. decline, a potential after the potential change becomes the second level or a level extremely close to the second level in a short time.

BRIEF DESCRIPTION OF DRAWINGS

These and other objects and features of the present invention will become clearer from the following description of the preferred embodiments given with reference to the attached drawings, in which.

DESCRIPTION OF THE PREFERRED EMBODIMENT

Figure 1:
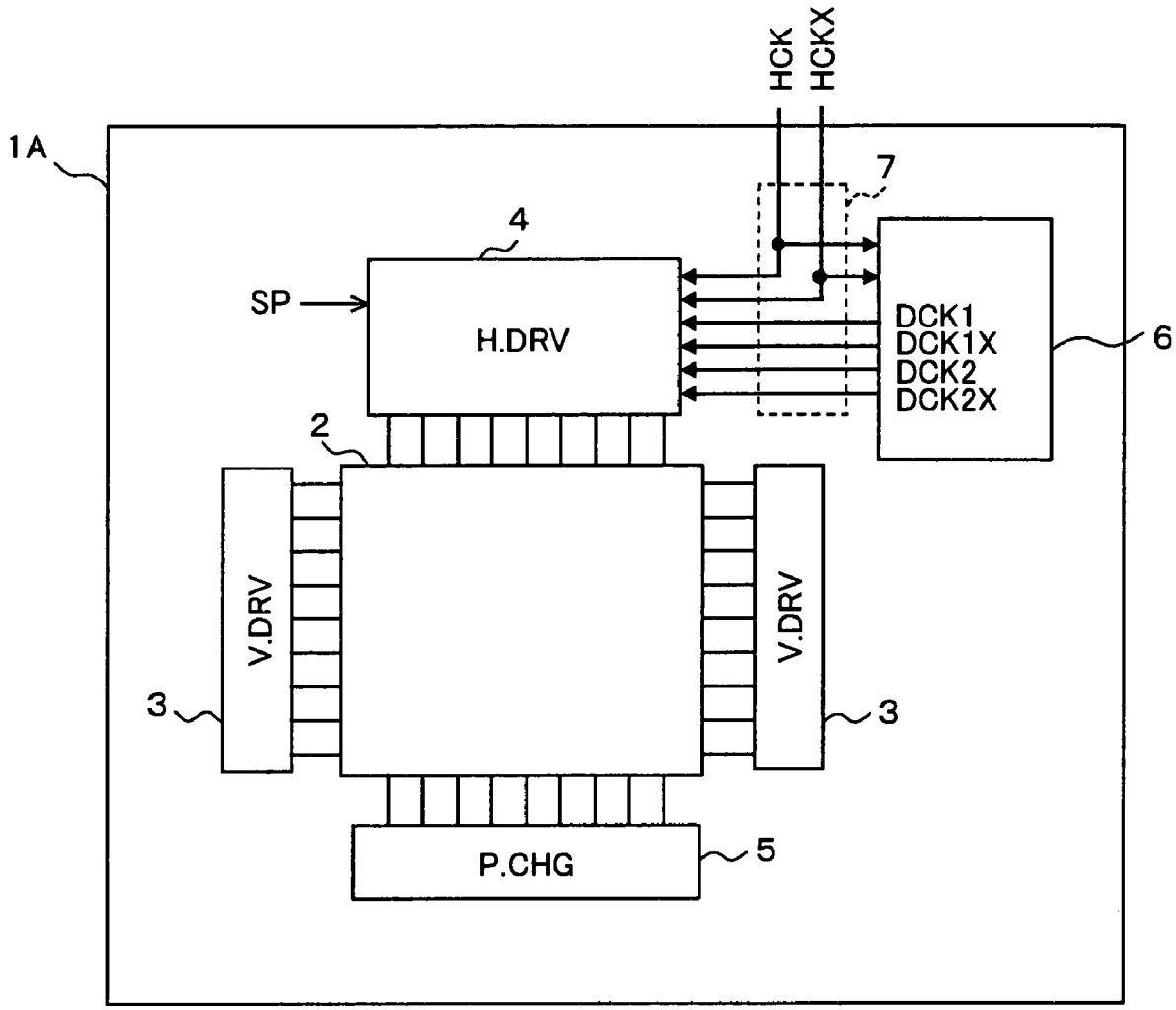
FIG. 1 is a block diagram of a first configuration example of an image display panel wherein a point sequential clock driving system according to an embodiment of the present invention is applied.
Figure 2:
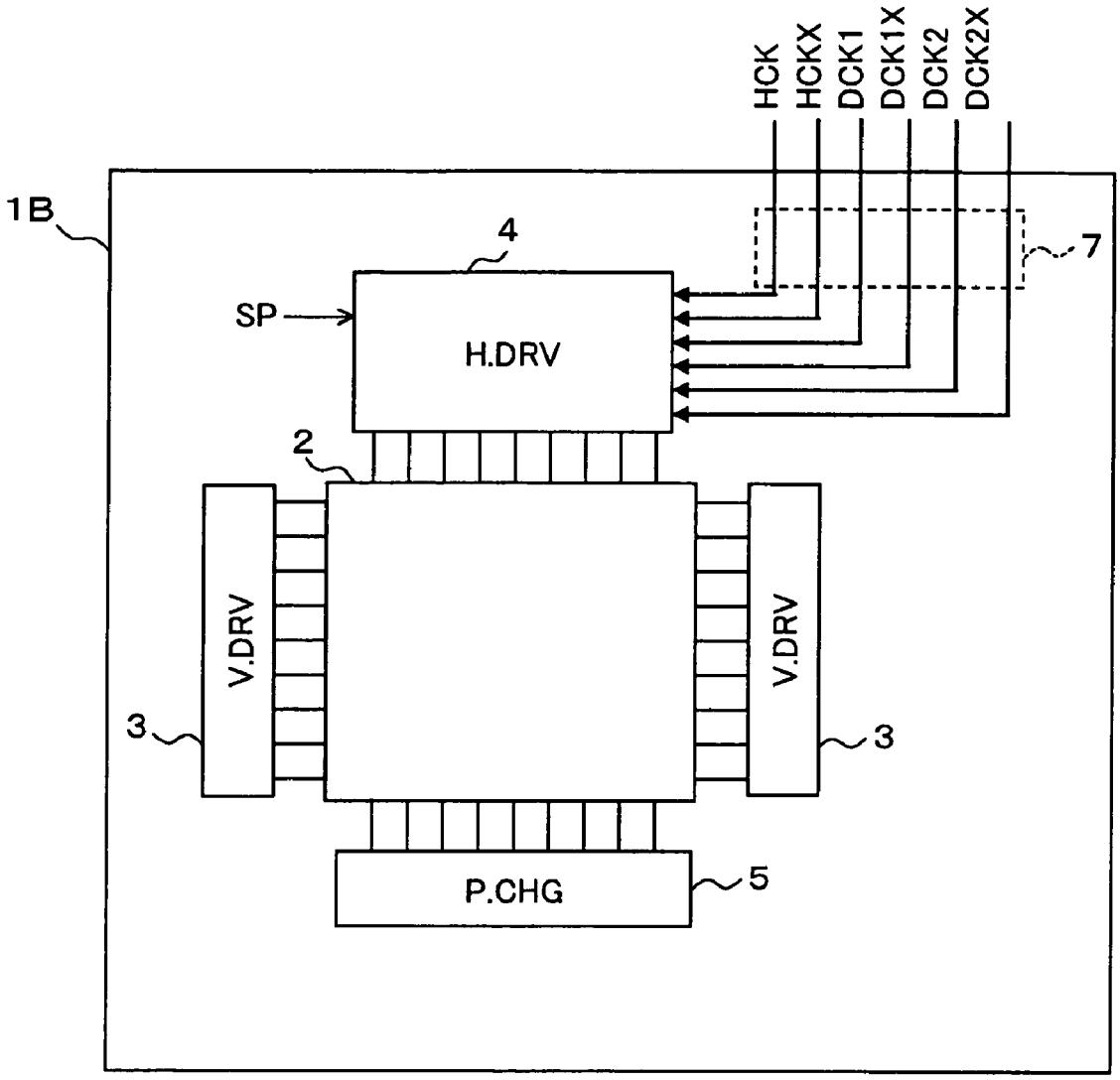
FIG. 2 is a block diagram of a second configuration example of an image display panel wherein a point sequential clock driving system according to an embodiment of the present invention is applied.

Below, embodiments of the present invention will be explained by taking a liquid crystal display device (LCD) as an example with reference to the drawings. The overall liquid crystal display panel has the same configuration as that shown in FIG. 1 and FIG. 2.

Figure 3:
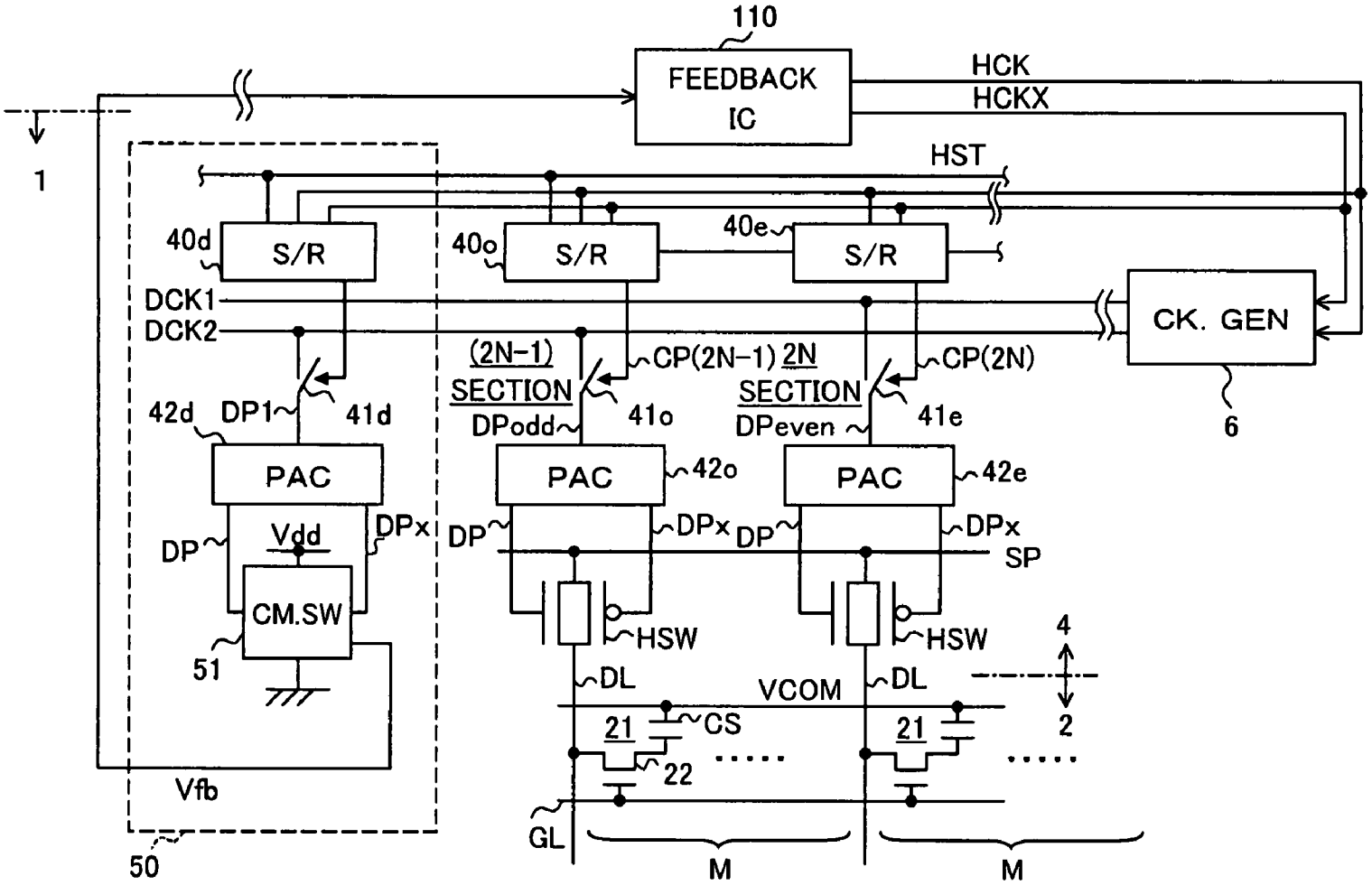
FIG. 3 is a circuit diagram of the detailed configuration of a liquid crystal panel.

FIG. 3 is a circuit diagram of a configuration example of a liquid crystal panel 1 wherein a point sequential clock driving system is applied. FIG. 4A to FIG. 4K are timing charts of waveforms of respective signals. Note that FIG. 3 corresponds to FIG. 1 and shows the case of generating a clock inside.

The pixel portion 2 has the configuration arranged with 1024×768 number of pixels 21 in matrix, for example, in the XGA specification. Each of the pixels 21 has a switching TFT 22, a holding capacitor Cs and a liquid crystal element (not shown). The holding capacitor Cs is formed between a pixel electrode connected to one of a source and a drain of the TFT 22 and a supply line of a common potential VCOM. The other of the source and drain of the TFT 22 is connected to a corresponding data line DL. The pixel 21 functions as a light modulation device which changes the transmissivity of a light in accordance with an amount of charges supplied via the TFT 22 and stored in a pixel electrode.

The pixels 21 are repeated by an even number, for example, 6 or 12, in the horizontal direction, and a unit of an image to be displayed at a time (hereinafter, simply referred to as a "section") is composed thereof. FIG. 3 shows an odd section, that is, (2N−1) (N is a natural number) and an even section, that is, 2N.

The horizontal drive circuit 4 is composed of a unit called a scanner provided to each section. A scanner in an odd (2N−1) section comprises a shift register unit (S/R) 40*o* driven by horizontal clocks HCK and HCKX supplied from outside the panel, a pulse-extraction switch 41*o*, a phase adjustment circuit (PAC) 42*o* and a data sampling switch HSW. Similarly, a scanner in an even (2N) section comprises a shift register unit (S/R) 40*e*, a pulse extraction switch 41*e*, a phase adjustment circuit (PAC) 42*e* and a data sampling switch HSW.

When an odd (2N−1) section shown in the figure is the first section, a horizontal start pulse HST is input to the shift register unit 40*o* in the scanner in the first section. Also, shift register units 40*o* and 40*e* of the scanners are successively connected between sections; consequently, one shift register as a whole is configured.

Figure 4:
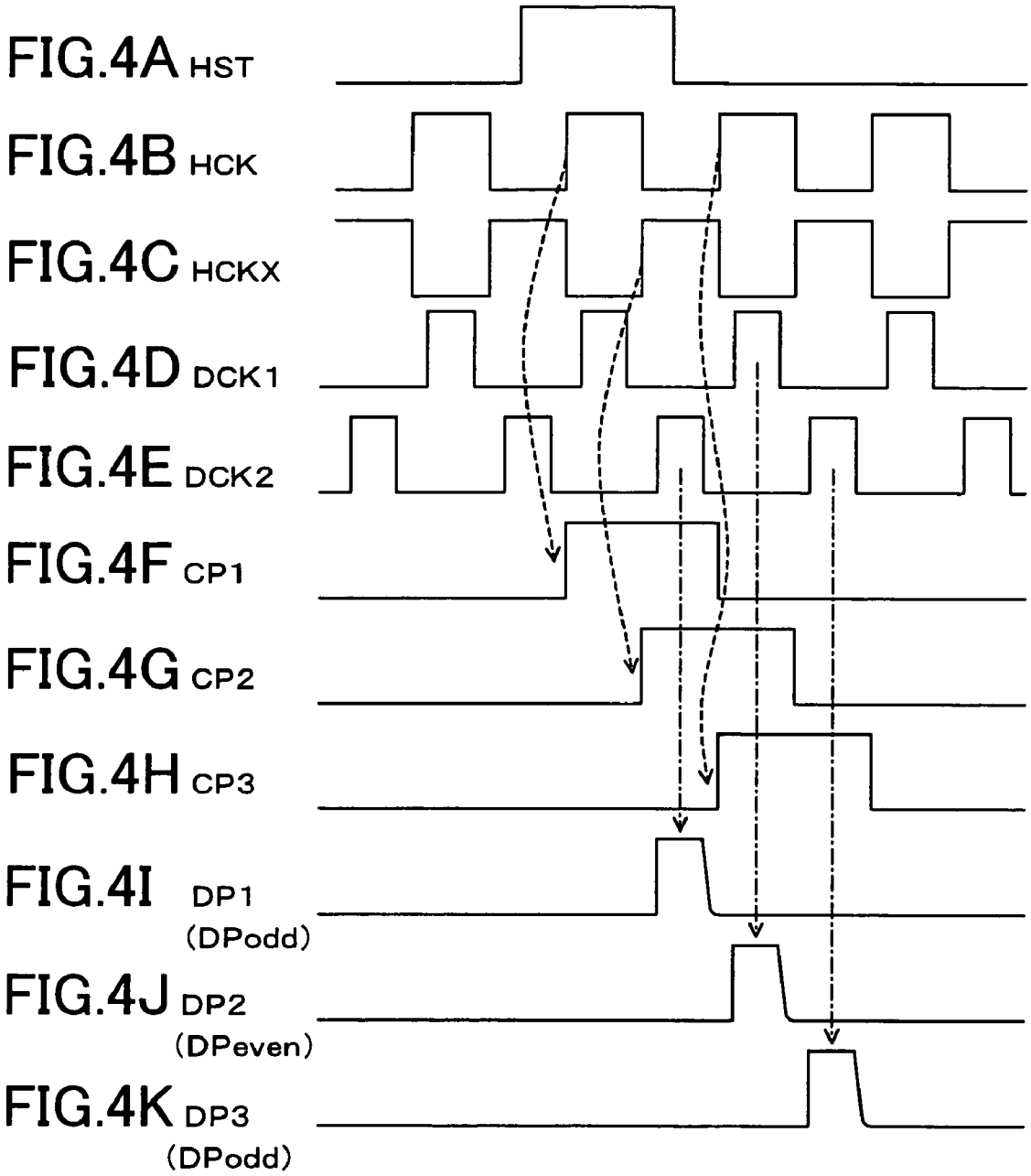
FIG. 4A to FIG. 4K are timing charts of waveforms of respective signals at the time of horizontal driving of the liquid crystal panel.

Each shift register unit 40*o* (or 40*e*) outputs a pulse being transferred that has the same pulse width as that of a start pulse HST to a control terminal of the pulse extraction switch 410 (or 41*e*) at a timing that the horizontal clocks HCK and HCKX rise, as shown in FIG. 4B to FIG. 4H. The extracted pulse will be called a clock sampling pulse below. As shown in FIG. 4F to FIG. 4H, clock sampling pulses CP1, CP2, CP3, . . . become a group of pulses delayed successively by one pulse from the horizontal clock HCK.

In an even (2N−1) section, the pulse extraction switch 41*o* is connected between a supply line of a drive clock DCK2 and the phase adjustment circuit 42*o*. Therefore, the pulse extraction switch 41*o* in an odd section extracts only one from pulses DPodd (DP1, DP3, . . . ) appearing on the supply line of the drive clock DCK2 in every turned-on period and sends the pulse to the phase adjustment circuit 42*o*.

Similarly, in an even section (2N), the pulse extraction switch 41*e* is connected between a supply line of a drive clock DCK1 and a phase adjustment circuit 42*e*. Therefore, the pulse extraction switch 41*e* in an even section extracts only one from pulses DPeven (DP2, DP4, . . . ) appearing on the supply line of the drive clock DCK1 in every turned-on period and sends the pulse to the phase adjustment circuit 42*e*.

The thus extracted pulses of a drive clock are called drive pulses. FIG. 4I to FIG. 4K show drive pulses DP1, DP2 and DP3.

The drive clocks DCK1 and DCK2 are generated as clocks having the same cycle as those of the horizontal clocks HCK and HCKX and a smaller duty ratio than those by a clock generation portion (CK.GEN) 6. Accordingly, drive pulses DP1, DP2, DP3, . . . generated by extracting drive clocks DCK1 and DCK2 become point sequential sampling pulses leaving intervals in accordance with the difference of the above duty ratio between adjacent pulses.

The sampling pulses are adjusted to be a pair of drive pulses DP and DPx having reversed phases to each other and a uniform half cycle phase difference in the phase adjustment circuit 42*o* or 42*e* and successively applied to the data sampling switch HSW. As a result, a video signal SP is supplied to the data line for every M-number of pixels in one display line wherein a gate line GL is selected, and high speed horizontal drive of the image display is performed.

By the horizontal drive of successively repeating gate lines to be selected, one screen (one field) is displayed.

In the present embodiment, as shown in FIG. 3, a scanner 50 for sampling timing detection called a dummy scanner is formed at a position adjacent of the scanner. In the present example, when the odd (2N−1) section shown in FIG. 3 is the first section, the dummy scanner 50 is provided, for example, on the scan start side (on the left side in FIG. 3) of the scanner of the first section.

The timing detection scanner 50 has the same configuration as that of the scanner for each data line, comprises a shift register unit 40*d*, a pulse extraction switch 41*d* and a phase adjustment circuit 42*d*, and has approximately the same connection relationship with that of the scanner in the first section. This is for making the timing detection scanner 50 operate in the same way as the scanner in the first section. Note that between the shift register unit 40*d* and the shift register unit 40*o* is separated so as not to affect the shift register operation.

In the present embodiment, a current mirror shaped switching circuit (CM.SW: hereinafter referred to as a current mirror switch) 51 is formed instead of the data sampling switch (HSW) in the timing detection scanner 50. The current mirror switch 51 configures an embodiment of a "timing detection circuit" of the present invention.

The current mirror switch 51 is supplied with a power source voltage Vdd and a ground potential GVD, and an output thereof is input to the feedback IC 110. The feedback IC 110 configures a "timing adjustment circuit" of the present invention. Note that being different from the case in FIG. 9, the feedback path is not pulled up by the resistance in the present embodiment.

Figure 5:
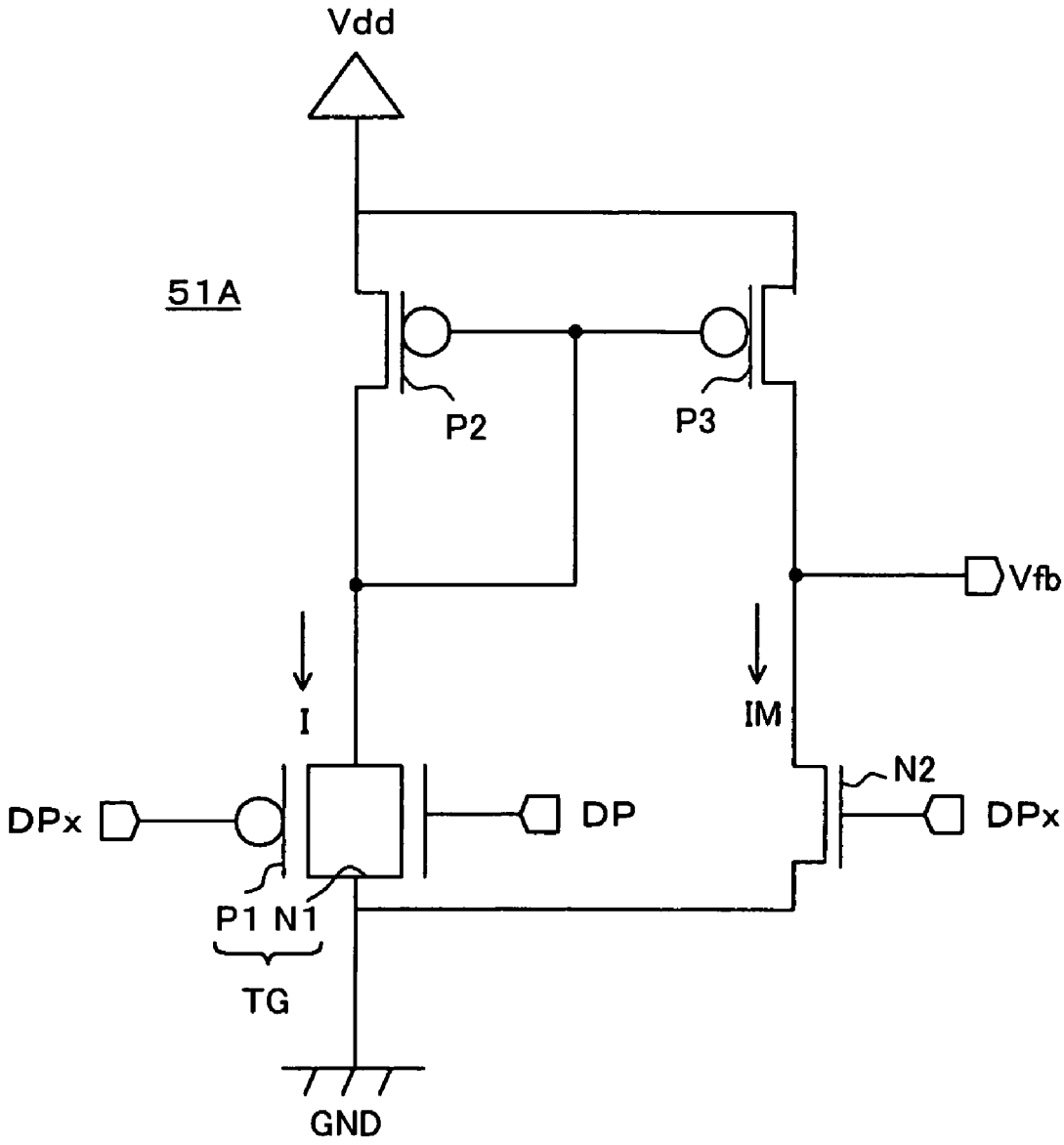
FIG. 5 is a circuit diagram of a first configuration example of a current mirror switch.
Figure 6:
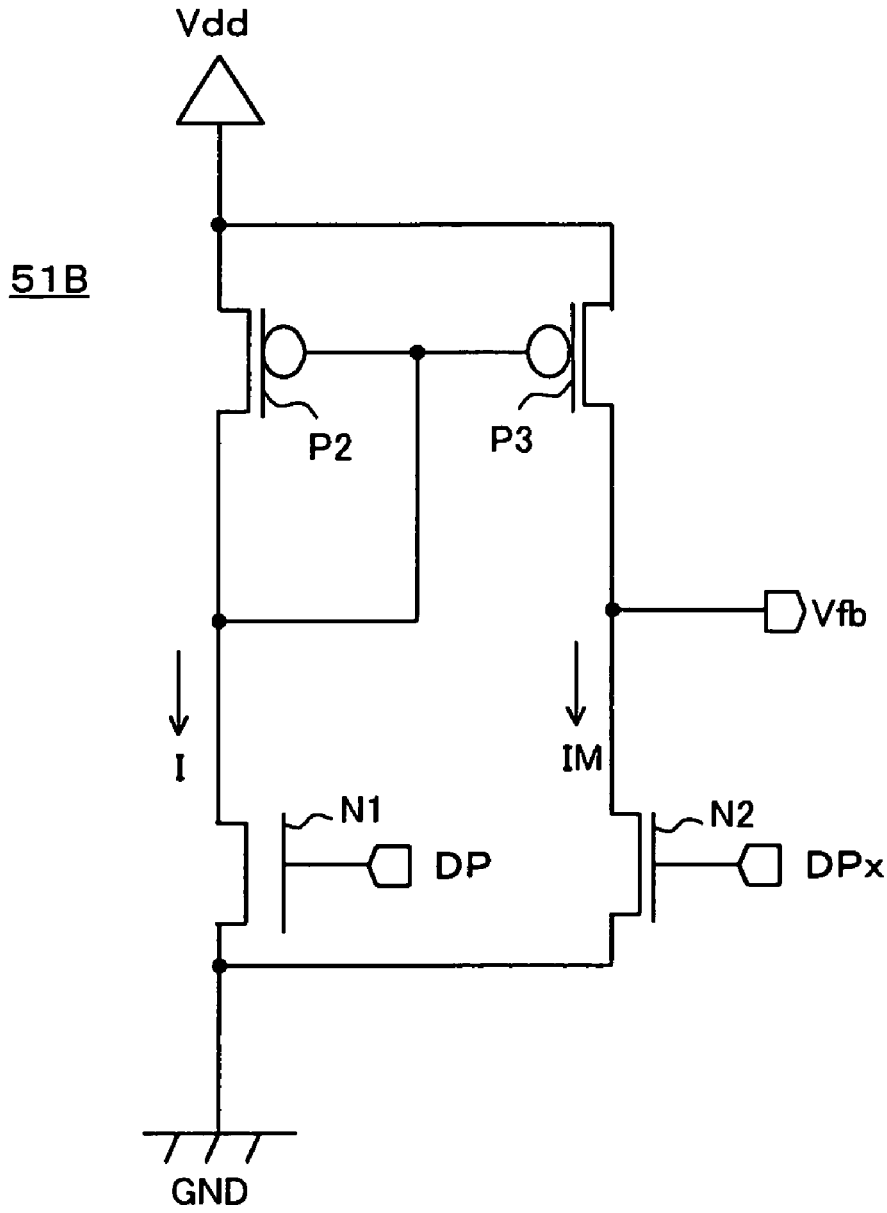
FIG. 6 is a circuit diagram of a second configuration example of a current mirror switch.

FIG. 5 and FIG. 6 are circuit diagrams of configuration examples of the current mirror switch 51.

The current mirror switch 51A shown in FIG. 5 comprises two NMOS transistor N1 and N2 and three PMOS transistors P1, P2 and P3. They are all made by TFT.

The transistor N1 composes the CMOS transfer gate TG, and the transfer gate TG and the transistor P2 are connected in series between the ground potential GND and the power source voltage Vdd. Also, the transistors N2 and P3 are serially connected between the ground potential GND and the power source voltage Vdd. Gates of the transistors P2 and P3 are connected to each other, and a middle point of the connection is connected to a drain of the transistor P2, and, thereby, a current mirror circuit is formed.

A gate of the NMOS transistor N1 of the transfer gate TG is applied with the drive pulse DP, and an inversion drive pulse DPx having the reversed phase is applied to the PMOS transistor P1. The inversion drive pulse DPx also is applied to a gate of the other NMOS transistor N2. From the middle of the connection of the transistors N2 and P3, a feedback output Vfb as a timing detection signal is extracted.

In the current mirror switch 51B shown in FIG. 6, instead of the transfer gate TG, an NMOS transistor N1 controlled by a drive pulse DP input to the gate is provided. The other configuration is the same as the first configuration shown in FIG. 1.

Figure 7:
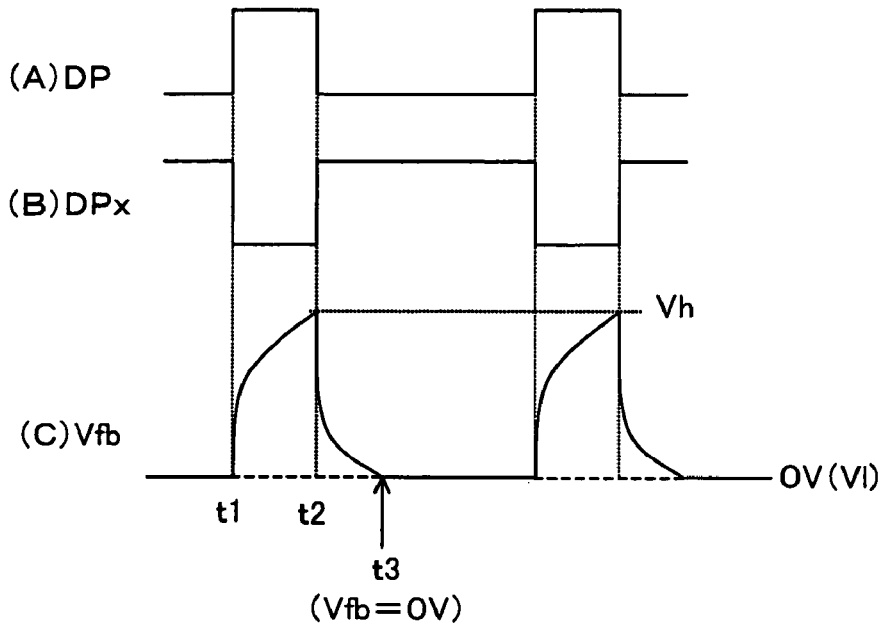
FIG. 7A to FIG. 7C are timing charts of waveforms of a drive pulse and a feedback output input to the current mirror switch.

FIG. 7A to FIG. 7C show waveforms of drive pulses DP and DPx input to the current mirror switch and the feedback output Vfb.

In an initial state where the drive pulse DP is not applied, since the inversion drive pulse DPx is at a high level, the transistor N2 on the output side turns on and a potential of the feedback Vfb becomes a ground potential GND.

At a time t1, when the drive pulse DP shifts from a low level to a high level and the inversion drive pulse DPx shifts from the high level to the low level, the transistor N1 (and P1) on the input side turns on and a current I flows thereto. A mirror current IM having approximately the same value as the current I flows to the output side, and a potential of the feedback output Vfb rises. However, since the transistor N2 shifts from turned-on to turned-off at the time t1 on the output side, a potential of the feedback output Vfb stops rising at a point of reaching a predetermined high level value Vh.

At a time t2, when the drive pulse DP shifts from a high level to a low level and the inversion drive pulse DPx shifts from the low level to the high level, the transistor N1 (and P1) on the input side turns off and the transistor N2 on the output side turns on. At this time, since the PMOS transistor P3 composing the current mirror portion turns off, a supply path of the power source voltage Vdd is cut off. Therefore, in a short period from time t2 to time t3, the potential of the feedback output Vfb is lowered swiftly to the ground potential GND. Here, the PMOS transistor P3 configures an embodiment of a "means for closing a current path on the first level side" of the present invention and the NMOS transistor configures an embodiment of a "means for opening a current path on the second level side" of the present invention, respectively.

The current mirror switch 51 repeats the operation every time the drive pulse DP is applied.

The above drive clocks DCK1 and DCK2 are generated, for example, by making the input horizontal clocks HCK and HCKX pass through many stages of inverters and other gate circuits in the clock generation portion 6. Therefore, when the TFT characteristics are declined, phases of the obtained drive clocks DCK1 and DCK2 deviate in some cases.

The feedback IC 110 receives as an input the feedback output Vfb output from the current mirror switch 51 and detects a phase deviation amount of the drive clocks DCK1 and DCK2 based on the feedback output Vfb. When phase deviation arises in the drive clocks DCK1 and DCK2, phase deviation also arises in the drive pulses DP and DPx generated based thereon. Therefore, a phase of an output Vfb of the current mirror switch 51 also deviates. Accordingly, based on the phase deviation amount of the output Vfb of the current mirror switch 51, the phase deviation amount of the drive clocks DCK1 and DCK2 can be detected.

Figure 8:
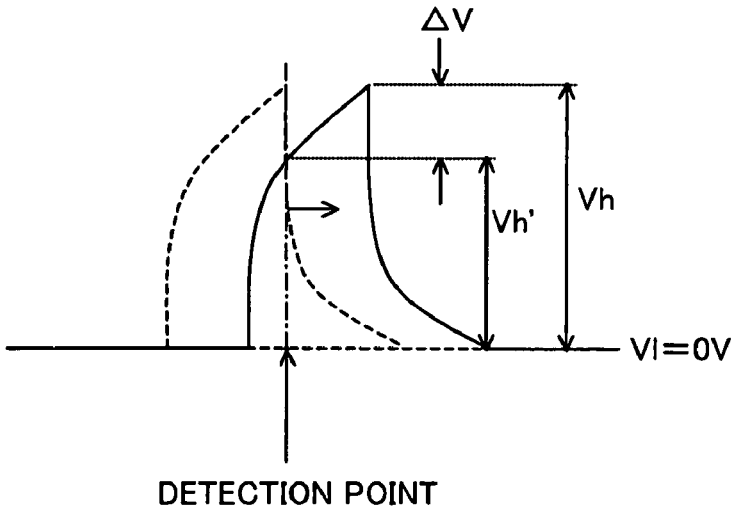
FIG. 8 is a view of a waveform of the feedback output wherein phase deviation arises.

FIG. 8 is a view of a waveform of a feedback output with phase deviation.

A broken line shown in FIG. 8 indicates the case without phase deviation, and the feedback IC 110 is assumed to detect an amplitude Vh near the maximum value. When phase deviation arises at this time, the amplitude of the feedback output being detected is lowered from Vh to Vh', and the voltage difference ΔV is detected. A phase deviation amount can be obtained from the voltage difference ΔV, so the feedback IC 110 adjusts the phases of the horizontal clocks HCK and HCKX as the whole origin in order to correct the voltage difference ΔV.

In the present embodiment, even when the characteristics of the TFT decline, the accuracy of phase adjustment is improved because a low level Vl for determining the amplitudes Vh and Vh' is stable.

Figure 9:
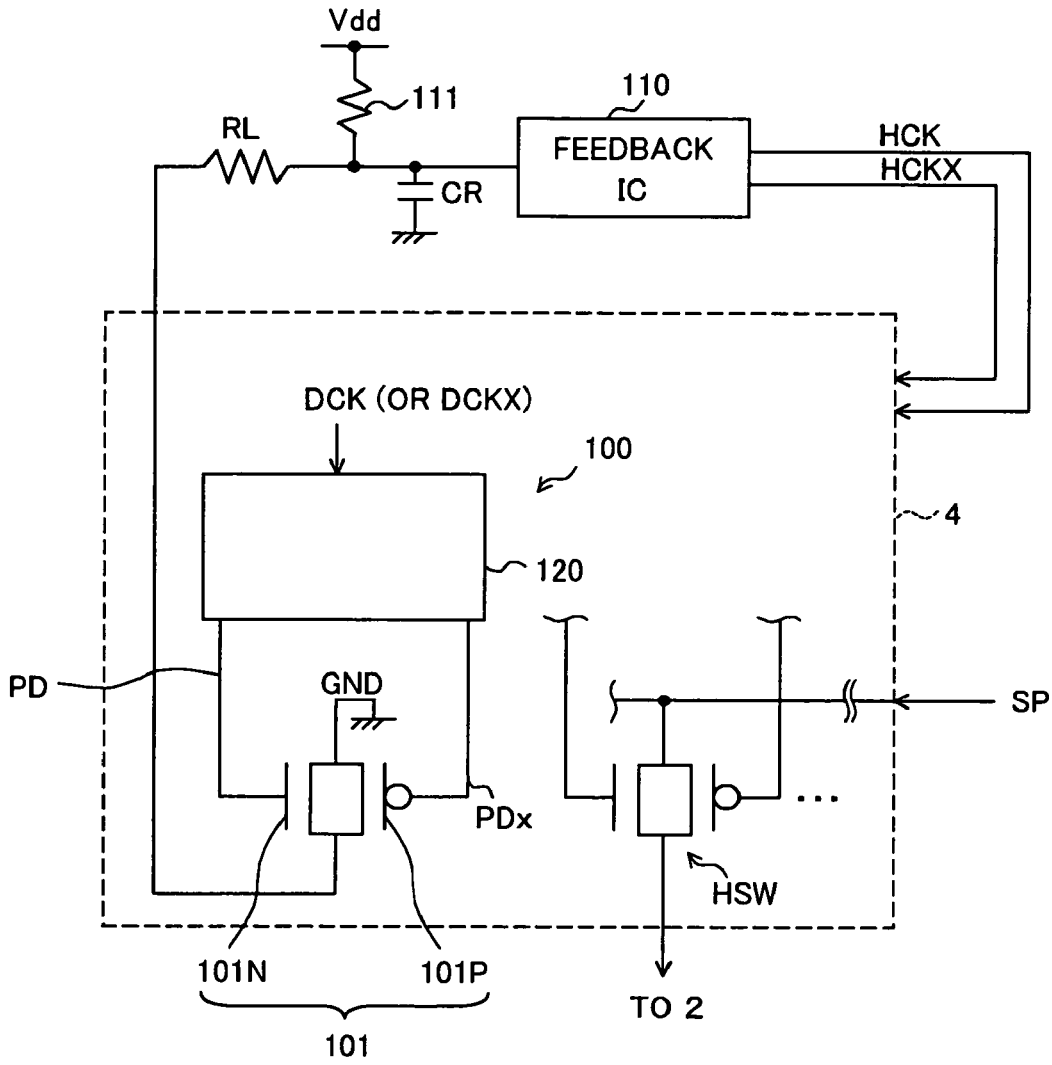
FIG. 9 is a circuit diagram of a configuration example of a detection circuit provided inside a horizontal drive circuit of the related art.

Also, in the case where the TFT characteristics declined and the low level of the output of the sampling switch was not lowered completely to 0V, a current constantly flew even in a state that the panel was turned off, which was a cause of wasteful power consumption in the configuration of the related art in FIG. 9. On the other hand, in the present embodiment, there is no wasteful power consumption because the transistor P3 is turned off. Note that when a decline of TFT characteristics is extreme, the transistor P3 cannot be completely turned off in some cases, but even in that case, wasteful power consumption can be made remarkably small compared with that in the related art due to an interaction of the transistors P3 and N2.

Here, the amplitude of the feedback output Vfb itself can be adjusted by changing the size of the PMOS transistors P2 and P3 of the current mirror portion.

Also, a falltime (t3−t2) of the feedback output waveform can be adjusted by changing a size of the NMOS transistor N2 on the output side.

Furthermore, in the case of being provided with the CMOS transfer gate TG shown in FIG. 5, the risetime of the feedback output Vfb can e changed by changing a size of the PMOS transistor P1 and the NMOS transistor N1 on the input side. On the other hand, in the configuration wherein only the NMOS transistor N1 is on the input side as shown in FIG. 6, only the falltime of the feedback output Vfb can be adjusted by changing a size of the transistor N2 on the output side.

In the present embodiment, since it is not necessary to pull up from the outside of the panel as in the related art, the configuration of an external circuit can be simplified. As a result, the circuit configuration becomes simple and the layout becomes easy to design.

According to the image display device and the image display panel of the present invention, it is possible to improve the accuracy of adjusting the sample timing of a video signal and prevent constant wasteful power consumption.

The embodiments explained above are for an easier understanding of the present invention and not to limit the present invention. Accordingly, respective elements disclosed in the above embodiments include all modifications in designs and equivalents belonging to the technical field of the present invention.

What is claimed is:

1. An image display device, having a pixel portion arranged with pixels in a matrix and a drive circuit including a switch circuit connected to each data line shared by pixels in each column of said pixel portion for sampling a video signal and successively outputting to the data line, comprising:

a timing detection circuit for generating a timing detection signal changing from a first level to a second level every time said switch circuit sends said video signal; and a timing adjustment circuit for adjusting an operation timing of said switch circuit based on said timing detection signal;

wherein said timing detection circuit includes at an output terminal of said timing detection signal a means for closing a current path on said first level side and a means for opening a current path on said second level side respectively in synchronization with a video signal sending operation of said switch circuit, and wherein:

said switch circuit comprises two reverse-conductive type transistors driven by two drive pulses having reversed phases and sources thereof are connected to each other and drains thereof are connected to each other; and said timing detection circuit is driven by two drive pulses having reversed phases generated by the same circuit configuration with that of said drive pulses for driving said switch circuit.

2. An image display device, having a pixel portion arranged with pixels in a matrix and a drive circuit including a switch circuit connected to each data line shared by pixels in each column of said pixel portion for sampling a video signal and successively outputting to the data line, comprising:

a timing detection circuit for generating a timing detection signal changing from a first level to a second level every time said switch circuit sends said video signal; and a timing adjustment circuit for adjusting an operation timing of said switch circuit based on said timing detection signal;

wherein said timing detection circuit includes at an output terminal of said timing detection signal a means for closing a current path on said first level side and a means for opening a current path on said second level side respectively in synchronization with a video signal sending operation of said switch circuit, and wherein:

said timing detection circuit has a current mirror type circuit configuration; and said means for closing a current path on said first level side comprises a P channel type transistor in a current mirror circuit operating in a reversed phase of that of said means for opening a current path on said second level side.

3. An image display panel, having a pixel portion arranged with pixels in a matrix and a drive circuit including a switch circuit connected to each data line shared by pixels in each column of said pixel portion for sampling a video signal and successively outputting to the data line, comprising:

a timing detection circuit for generating a timing detection signal to be output to the outside of the panel, changing from a first level to a second level every time said switch circuit sends said video signal; and wherein said timing detection circuit includes at an output terminal of said timing detection signal a means for closing a current path on said first level side and a means for opening a current path on said second level side respectively in synchronization with a video signal sending operation of said switch circuit, and wherein:

said timing detection circuit has a current mirror type circuit configuration; and said means for closing a current path on said first level side comprises a P channel type transistor in a current mirror circuit operating in a reversed phase of that of said means for opening a current path on said second level side.

4. An image display panel, having a pixel portion arranged with pixels in a matrix and a drive circuit including a switch circuit connected to each data line shared by pixels in each column of said pixel portion for sampling a video signal and successively outputting to the data line, comprising:

a timing detection circuit for generating a timing detection signal to be output to the outside of the panel, changing from a first level to a second level every time said switch circuit sends said video signal; and wherein said timing detection circuit includes at an output terminal of said timing detection signal a means for closing a current path on said first level side and a means for opening a current path on said second level side respectively in synchronization with a video signal sending operation of said switch circuit, and wherein:

said switch circuit comprises two reverse-conductive type transistors driven by two drive pulses having reversed phases and sources thereof are connected to each other and drains thereof are connected to each other; and said timing detection circuit is driven by two drive pulses having reversed phases generated by the same circuit configuration with that of said drive pulses for driving said switch circuit.

5. An image display device, having a pixel portion arranged with pixels in a matrix and a drive circuit including a switch circuit connected to each data line shared by pixels in each column of said pixel portion for sampling a video signal and successively outputting to the data line, comprising:

a timing detection circuit, having a current mirror type circuit configuration for generating a timing detection signal changing from a first level to a second level every time said switch circuit sends said video signal; and a timing adjustment circuit for adjusting an operation timing of said switch circuit based on said timing detection signal;

wherein said timing detection circuit includes at an output terminal of said timing detection signal a means for closing a current path on said first level side and a means for opening a current path on said second level side respectively in synchronization with a video signal sending operation of said switch circuit.

6. An image display device as set forth in claim 5, wherein:

said means for closing a current path on said first level side comprises a transistor in said current mirror circuit operating in a reversed phase of that of said means for opening a current path on said second level side.

7. An image display device as set forth in claim 5, wherein said current mirror type circuit configuration comprises:

first and second transistors of a first conductive type, each having a region connected to the other and a gate connected to an operative pulse source;

third and fourth transistors of a second conductive type opposite said first conductive type, each having a gate commonly connected and a region commonly connected, and a point between said gates connected to a point in common with said first and fourth transistor, a gate of said first transistor connected to one of a pulse source or an inversion pulse source, and a fifth transistor of the second conductivity type having a gate connected to one of said pulse source and said inversion pulse source.

8. An image display panel, having a pixel portion arranged with pixels in a matrix and a drive circuit including a switch circuit connected to each data line shared by pixels in each column of said pixel portion for sampling a video signal and successively outputting to the data line, comprising:

a timing detection circuit, having a current mirror type circuit configuration, for generating a timing detection signal to be output to the outside of the panel, changing from a first level to a second level every time said switch circuit sends said video signal; and wherein said timing detection circuit includes at an output terminal of said timing detection signal a means for closing a current path on said first level side and a means for opening a current path on said second level side respectively in synchronization with a video signal sending operation of said switch circuit.

9. An image display panel as set forth in claim 8, wherein: said means for closing a current path on said first level side comprises a transistor in a current mirror circuit operating in a revered phase of that of said means for opening a current path on said second level side.

10. An image display device as set forth in claim 8, wherein said current mirror type circuit configuration comprises:

first and second transistors of a first conductive type, each having a region connected to the other and a gate connected to an operative pulse source;

third and fourth transistors of a second conductive type opposite said first conductive type, each having a gate commonly connected and a region commonly connected, and a point between said gates connected to a point in common with said first and fourth transistor, a gate of said first transistor connected to one of a pulse source or an inversion pulse source, and a fifth transistor of the second conductivity type having a gate connected to one of said pulse source and said inversion pulse source.

* * * * *

UNITED STATES PATENT AND TRADEMARK OFFICE

CERTIFICATE OF CORRECTION

PATENT NO. : 7,212,186 B2
APPLICATION NO. : 10/755224
DATED : May 1, 2007
INVENTOR(S) : Shuzo Sato et al.

It is certified that error appears in the above-identified patent and that said Letters Patent is hereby corrected as shown below:

Column 11, Line 13:
"revered" should read -- reversed --.

Signed and Sealed this

Eighteenth Day of September, 2007

JON W. DUDAS
*Director of the United States Patent and Trademark Office*